US008529748B2

(12) United States Patent
Uchida et al.

(10) Patent No.: US 8,529,748 B2
(45) Date of Patent: Sep. 10, 2013

(54) FUNCTIONAL SOLUTION SUPPLY SYSTEM

(75) Inventors: Minoru Uchida, Tokyo (JP); Tatsuo Nagai, Tokyo (JP); Haruyoshi Kamakawa, Tokyo (JP)

(73) Assignee: Kurita Water Industries Ltd. (JP)

( * ) Notice: Subject to any disclaimer, the term of this patent is extended or adjusted under 35 U.S.C. 154(b) by 286 days.

(21) Appl. No.: 12/737,079

(22) PCT Filed: Mar. 11, 2009

(86) PCT No.: PCT/JP2009/054631

§ 371 (c)(1),
(2), (4) Date: Dec. 6, 2010

(87) PCT Pub. No.: WO2009/125642

PCT Pub. Date: Oct. 15, 2009

(65) Prior Publication Data

US 2011/0120857 A1 May 26, 2011

(30) Foreign Application Priority Data

Apr. 8, 2008 (JP) ..... 2008-099888

(51) Int. Cl.
*C25B 1/30* (2006.01)
*H01L 21/306* (2006.01)

(52) U.S. Cl.
USPC ..... 205/471; 205/472; 205/554; 204/239; 204/242

(58) Field of Classification Search
USPC ..... 204/237, 242, 239; 205/471, 472, 205/554
See application file for complete search history.

(56) References Cited

U.S. PATENT DOCUMENTS

2005/0139487 A1* 6/2005 Zwicker et al. ..... 205/701
2008/0251108 A1* 10/2008 Nagai et al. ..... 134/56 R

FOREIGN PATENT DOCUMENTS

| | | |
|---|---|---|
| JP | 02-106929 | 4/1990 |
| JP | 2006-278838 | 10/2006 |
| JP | 2007-266495 | 10/2007 |
| JP | 2008-053484 | 3/2008 |
| JP | 2008-111184 | 5/2008 |

* cited by examiner

*Primary Examiner* — Arun S Phasge
(74) *Attorney, Agent, or Firm* — Baker & Hostetler LLP

(57) ABSTRACT

A sulfuric acid electrolyte is produced efficiently as a functional solution and persulfuric acid produced by electrolysis is supplied efficiently to a use side while suppressing self-decomposition thereof.

A functional solution supply system adapted to electrolyze a sulfuric acid solution to prepare a functional solution and supply the functional solution to a use side, comprises a storage tank 2 for storing the sulfuric acid solution, an electrolyzing apparatus (electrolytic cell 3) for electrolyzing the sulfuric acid solution, heating means (heater 5) for heating the sulfuric acid solution, cooling means (cooler 4) for cooling the sulfuric acid solution, a first circulation line 11 for returning the sulfuric acid solution discharged from the storage tank 2 to the storage tank 2 through the electrolyzing apparatus without passing through the heating means, a second circulation line 12 for returning the sulfuric acid solution introduced from the use side (cleaning machine 1) to the use side through the cooling means and the storage tank 2 in this order without passing through the heating means, and a third circulation line 13 for returning the sulfuric acid solution introduced from the use side to the use side through the heating means (heater 5) without passing through the cooling means and the storage tank 2.

17 Claims, 2 Drawing Sheets

(a) three-loops type (b) three-loops type (c) three-loops type

PRIOR ART

FUNCTIONAL SOLUTION SUPPLY SYSTEM

TECHNICAL FIELD

The present invention relates to a functional solution supply system capable of supplying a functional solution containing persulfuric acid, for example, as a cleaning solution.

BACKGROUND ART

A one loop type shown in FIG. 2(*a*) is known as a simplest system configuration of a semiconductor wafer resist stripping system which uses a persulfuric acid solution prepared by the electrolysis of a sulfuric acid solution.

In this system, an liquid outlet side of a cleaning machine 21 and an liquid inlet side of an electrolytic cell 23 are connected together by a feed line of a circulation line 31 through a cooler 24 and a storage tank 22, and an liquid outlet side of the electrolytic cell 23 and an liquid inlet side of the cleaning machine 21 are connected together by a return line of the circulation line 31 through a heater 25. Thus, the components are connected together in one loop.

This system has advantage of a reduced number of pumps and valves, but involves the following problems.

In the case where the amount of persulfuric acid required per unit time in the cleaning machine is large, that is, in the case where the ion dose for a semiconductor wafer is large or the resist thickness is large or the processing time is to be shortened, it is necessary to install a large number of electrolytic cells in order to produce a persulfuric acid solution of a high concentration. However, an increase in the amount of a sulfuric acid solution circulated leads to an increase of a cooling load on the cooler and an increase of a reheating load on the heater. If the amount of the sulfuric acid solution circulated is small, it is impossible to maintain a proper flow rate distribution of the sulfuric acid solution in the interior of the electrolytic cell.

These problems may be solved by adopting a two loops type shown in FIGS. 2(*b*) and 2(*c*) or a three loops type shown in FIG. 2(*d*). (See, for example, FIG. 2 in Patent Document 1.)

In the system of FIG. 2(*b*), a cleaning machine 21 and a storage tank 22 are connected together by a feed line of a circulation line 31*a*, and the storage tank 22 and the cleaning machine 21 are connected together by a return line of the circulation line 31*a* through a heater 25. Further, the storage tank 22 and an electrolytic cell 23 are connected together by a feed line of a circulation line 31*b* through a cooler 26, and the electrolytic cell 23 and the storage tank 22 are connected together by a return line of the circulation line 31*b*. A heater 27 is installed in the storage tank 22 to prevent a drop in temperature of a circulating solution. That is, the components are connected together in two loops, one of which is formed by the feed line of the circulation line 31*a* and the return line of the circulation line 31*a* and the other of which is formed by the feed line of the circulation line 31*b* and the return line of the circulation line 31*b*.

In the system of FIG. 2(*c*), a cleaning machine 21 and a storage tank 22 are connected together by a feed line of a circulation line 31*a*, and the storage tank 22 and the cleaning machine 21 are connected together by a return line of the circulation line 31*a* through a heater 25. Further, the storage tank 22 and an electrolytic cell 23 are connected together by a circulation line 31*b* through a cooler 26, and the electrolytic cell 23 and the cleaning machine 21 are connected together by a circulation line 31. A heater 27 is installed in the storage tank 22 to prevent a drop in temperature of a circulating solution. That is, the components are connected together in two loops, one of which is formed by the feed line of the circulation line 31*a* and the return line of the circulation line 31*a* and the other of which is formed by the feed line of the circulation line 31*a*, the circulation line 31*b* and the circulation line 31.

In the system of FIG. 2(*d*), a cleaning machine 21 and a storage tank 22 are connected together by a feed line of a circulation line 31*a*, and the storage tank 22 and the cleaning machine 21 are connected together by a return line of the circulation line 31*a* through a heater 25. Further, the storage tank 22 and an electrolytic cell 23 are connected together by a feed line of a circulation line 31*b* through a cooler 26, and the electrolytic cell 23 and the storage tank 22 are connected together by a return line of the circulation line 31*b*. Further, the electrolytic cell 23 and the cleaning machine 21 are connected together by a circulation line 31. A heater 27 is installed in the storage tank 22 to prevent a drop in temperature of a circulating solution. That is, the components are connected together in three loops, which are the loop formed by the feed line of the circulation line 31*a* and the return line of the circulation line 31*a*, the loop formed by the feed line of the circulation line 31*b* and the return line of the circulation line 31*b*, and the loop formed by the feed line of the circulation line 31*a*, the feed line of the circulation line 31*b* and the circulation line 31.

Thus, in the conventional art, the storage tank was used as a reaction site for expediting a resist decomposing reaction secondarily.

Patent Document 1: Japanese Patent Laid-Open No. 2007-266495

DISCLOSURE OF THE INVENTION

Problems to be Solved by the Invention

In the system of FIG. 2(*b*), a persulfuric acid solution produced in the electrolytic cell 23 is added, in the storage tank 22, to the circulating solution which contains residual resist discharged from the cleaning machine 21. Therefore, the resist can be decomposed positively in the storage tank 22. Besides, since the adjustment of a flow rate in the loop circulating from the storage tank 22 through the electrolytic cell 23 can be done substantially independently of a flow rate in the loop circulating from the cleaning machine 21 through the storage tank 22, a proper flow rate distribution of the sulfuric acid solution can be maintained in the interior of the electrolytic cell 23 irrespective of an increase or decrease in the amount of the sulfuric acid solution circulating to the cleaning machine 21.

However, since the total amount of the circulating solution from the cleaning machine 21 is circulated through the storage tank 22, it is necessary to install the heater 27 separately in the storage tank 22 in order to decrease the load on the heater 25 at the time of feeding the stored solution of a lowered temperature from the storage tank 22 back to the cleaning machine 21. With the heater 27, the sulfuric acid solution in the storage tank 22 is held at a high temperature, so that the persulfuric acid flowing into the storage tank 22 decomposes by itself immediately, thus giving rise to the problem that it is difficult to supply a highly concentrated persulfuric acid solution to the cleaning machine 21.

In the system of FIG. 2(*c*), since the adjustment of a flow rate in the loop circulating from the cleaning machine 21 through both storage tank 22 and electrolytic cell 23 can be done substantially independently of a flow rate in the loop circulating from the cleaning machine 21 through the storage tank 22, a proper flow rate distribution of the sulfuric acid solution can be maintained in the interior of the electrolytic cell 23 irrespective of an increase or decrease in the amount of the sulfuric acid solution circulating to the cleaning machine 21. Besides, since the cooled sulfuric acid solution is electrolyzed, a persulfuric acid solution can be produced with high efficiency of electrolysis. Moreover, since the persulfuric acid solution is not heated in the circulation line 31, it can be supplied to the cleaning machine 21 before progress of the self-decomposition.

However, there is a problem that in the case where the amount of persufuric acid required per unit time in the cleaning machine 21 is large, that is, in the case where the ion dose for a semiconductor wafer is large or the resist thickness is large or the processing time is to be shortened, it becomes necessary to install a large number of electrolytic cells 23 in order to produce a highly concentrated persulfuric acid solution in a short time.

In the system of FIG. 2(*d*), since the persulfuric acid solution produced in the electrolytic cell 23 is added, in the storage tank 22, to the circulating solution which contains residual resist discharged from the cleaning machine 21, the resist can be decomposed positively. Besides, since the adjustment of a flow rate in the loop circulating from the cleaning machine 21 through both storage tank 22 and the electrolytic cell 23 and the adjustment of flow rate in the loop circulating from the storage tank 22 through the electrolytic cell 23 can be done substantially independently of a flow rate in the loop circulating from the cleaning machine 21 through the storage tank 22, a proper flow rate distribution of the sulfuric acid solution can be maintained in the interior of the electrolytic cell 23 irrespective of an increase or decrease in the amount of the sulfuric acid solution circulating to the cleaning machine 21. Moreover, since the cooled sulfuric acid solution is electrolyzed, a persulfuric acid solution can be produced with high efficiency of electrolysis. Further, since the persulfuric acid solution is not heated in the circulation line 31, it can be supplied to the cleaning machine 21 before progress of the self-decomposition.

However, also in this case, since the total amount of the circulating solution from the cleaning machine 21 is circulated to the storage tank 22, it is necessary to install the heater 27 separately in the storage tank 22 in order to decrease the load on the heater 25 at the time of feeding the stored solution of a lowered temperature from the storage tank 22 back to the cleaning machine 21. With the heater 27, the sulfuric acid solution in the storage tank 22 is held at a high temperature, so that the persulfuric acid flowing into the storage tank 22 decomposes by itself immediately. Thus, there still remains a problem that it is difficult to supply a highly concentrated persulfuric acid solution to the cleaning machine 21. Further, there still remains a problem that in the case where the amount of persulfuric acid required per unit time in the cleaning machine 21 is large, that is, in the case where the ion dose for a semiconductor wafer is large or the resist thickness is thick or the processing time is to be shortened, it becomes necessary to install a large number of electrolytic cells 23 in order to produce a highly concentrated persulfuric acid solution.

The present invention has been accomplished under the above circumstances and it is an object of the invention to provide a functional solution supply system capable of producing a functional solution of high performance while decreasing the number of electrolytic cells installed and further capable of supplying the functional solution to a use side.

Means for Solving the Problems

That is, the functional solution supply system of a first aspect of the present invention is a functional solution supply system for electrolyzing a sulfuric acid solution to prepare a functional solution and supplying the functional solution to a use side, the system comprising a storage tank for storing the sulfuric acid solution, an electrolyzing apparatus for electrolyzing the sulfuric acid solution, heating means for heating the sulfuric acid solution, cooling means for cooling the sulfuric acid solution, and the following three circulation lines:

1. a first circulation line for returning the sulfuric acid solution discharged from the storage tank to the storage tank through the electrolyzing apparatus without passing through the heating means;

2. a second circulation line for returning the sulfuric acid solution introduced from the use side to the use side through the cooling means and the storage tank in this order without passing through the heating means; and 3. a third circulation line for returning the sulfuric acid solution introduced from the use side to the use side through the heating means without passing through the cooling means and the storage tank.

The functional solution supply system of a second aspect of the present invention is characterized in that the second circulation line and the third circulation line join just before the return to the use side in the above first aspect.

The functional solution supply system of a third aspect of the present invention is characterized in that the second circulation line and the third circulation line are branched after being introduced from the use side in the above first or second aspect.

The functional solution supply system of a fourth aspect of the present invention is characterized in that on a downstream side of the storage tank and on an upstream side of the electrolyzing apparatus the first circulation line includes second cooling means for cooling the sulfuric acid solution in any of the above first to third aspects.

The functional solution supply system of a fifth aspect of the present invention is characterized in that on a downstream side of the electrolyzing apparatus and on an upstream side of the storage tank the first circulation line includes second cooling means for cooling the sulfuric acid solution in any of the above first to third aspects.

The functional solution supply system of a sixth aspect of the present invention is characterized in that the use side is a batch type substrate cleaning apparatus in any of the above first to fifth aspects.

Effect of the Invention

The functional solution supply system according to the present invention for electrolyzing a sulfuric acid solution to prepare a functional solution and supplying the functional solution to a use side: comprises a storage tank for storing the sulfuric acid solution, an electrolyzing apparatus for electrolyzing the sulfuric acid solution, heating means for heating the sulfuric acid solution, cooling means for cooling the sulfuric acid solution, and the following circulation lines:

1. a first circulation line for returning the solution discharged from the storage tank to the storage tank through the electrolyzing apparatus without passing through the heating means;

2. a second circulation line for returning the sulfuric acid solution introduced from the use side to the use side through the cooling means and the storage tank in this order without passing through the heating means; and 3. a third circulation line for returning the sulfuric acid solution introduced from the use side to the use side through the heating means without passing through the cooling means and the storage tank.

Thus, by providing the first circulation line, persulfuric acid can be stored in the interior of the storage tank at a high concentration with a small electrolyzing capacity. Moreover, by providing the second and third circulation lines, the persulfuric acid solution can be heated up in a short time and hence can be supplied as a functional solution of high performance to the use side prior to self-decomposition of persulfuric acid.

EXPLANATION OF REFERENCE NUMERALS

Figure 1:
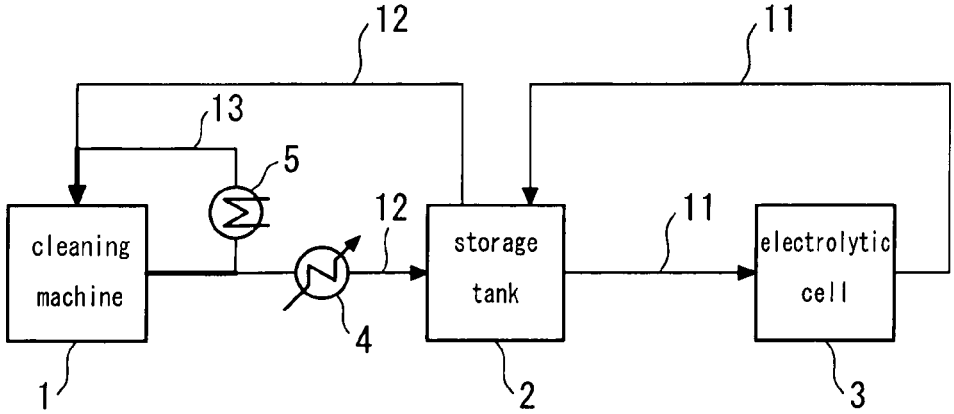
FIG. 1 is a diagram showing a functional solution supply system according to an embodiment of the present invention and functional solution supply systems according to modifications thereof.
Figure 1:
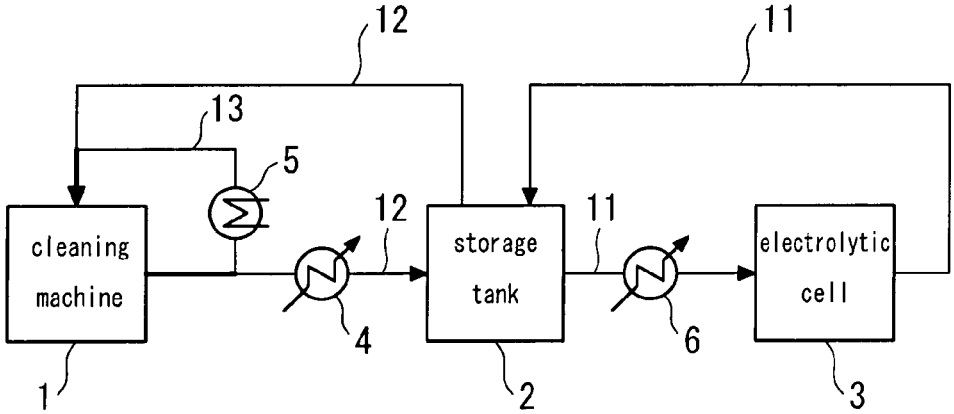
Figure 1:
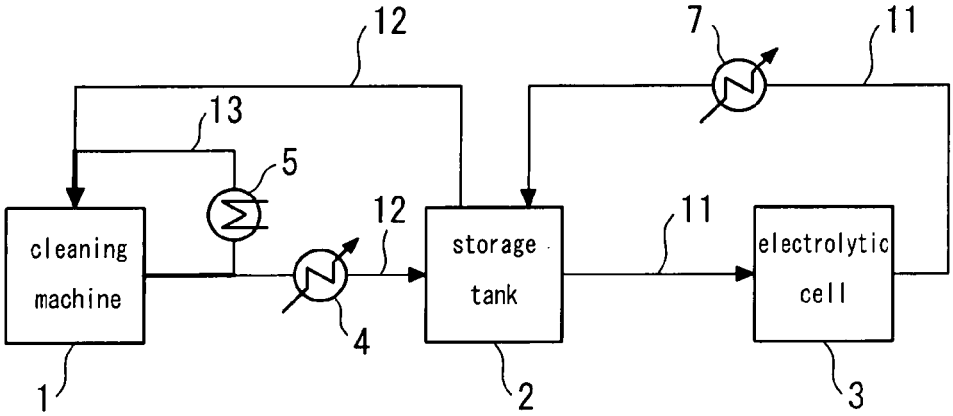

1 cleaning machine
2 storage tank
3 electrolytic cell
4 cooler
5 heater
6 cooler
7 cooler
11 first circulation line
12 second circulation line
13 third circulation line

BEST MODE FOR CARRYING OUT THE INVENTION

An embodiment of the present invention will be described below on the basis of FIG. 1(*a*).

A functional solution supply system of this embodiment includes a cleaning machine 1 which is a batch type substrate cleaning apparatus on a use side, a storage tank 2 for storing a sulfuric acid solution, and an electrolytic cell 3 which is an electrolyzing apparatus for electrolyzing the sulfuric acid solution.

A liquid discharge side of the storage tank 2 and an liquid inlet side of the electrolytic cell 3 are connected together by a feed line of a first circulation line 11, while a liquid discharge side of the electrolytic cell 3 and an liquid inlet side of the storage tank 2 are connected together by a return line of the first circulation line 11. That is, the storage tank 2 and the electrolytic cell 3 are connected together by the first circulation line 11 to permit circulation of the sulfuric acid solution.

A liquid discharge side of the cleaning machine 1 and an liquid inlet side of the storage tank 2 are connected together by a feed line of a second circulation line 12, while a liquid discharge side of the storage tank 2 and an liquid inlet side of the cleaning machine 1 are connected together by a return line of the second circulation line 12. That is, the cleaning machine 1 and the storage tank 2 are connected together by the second circulation line 12 to permit circulation of the sulfuric acid solution.

Further, a third circulation line 13 shares a part with the feed line of the second circulation line 12 so as to be connected to the liquid discharge side of the cleaning machine 1 and branches on a downstream side of the common part. At a position just before the liquid inlet side of the cleaning machine 1 the third circulation line 13 joins the return line of the second circulation line 12 so as to be connected to the liquid inlet side of the cleaning machine 1. Thus, the functional solution supply system of the present invention is a three loops type system different from the conventional art.

On a downstream side of the branched position of the third circulation line 13 and on an upstream side of the position where the second circulation line 12 is connected to the liquid inlet side of the storage tank 2, a cooler 4 as cooling means is disposed in the second circulation line 12, while on a downstream side of the position where the third circulation line 13 branches from the second circulation line 12 and at a position before the confluent position where the third circulation line 13 joins the second circulation line 12, a heater 5 as heating means is disposed in the third circulation line 13.

The following description is now provided about the operation of the above functional solution supply system.

A sulfuric acid solution, which is preferably heated to 40~80° C., is stored in the storage tank 2. Persulfuric acid is produced by electrolyzing the sulfuric acid solution while the sulfuric acid solution is circulated between the storage tank 2 and the electrolytic cell 3 through the first circulation line 11. The persulfuric acid, as a sulfuric acid solution containing highly concentrated persulfuric acid, is stored in the storage tank 2. In the present invention, the construction of the electrolytic cell is not specially limited, but an electrolytic cell having a diamond electrode at least as an anode is preferred.

The highly concentrated persulfuric acid-containing sulfuric acid solution stored in the storage tank 2 is fed to the cleaning machine 1 through the return line of the second circulation line 12. On the other hand, the sulfuric acid solution which has been used in the cleaning machine 1 passes through the feed line of the second circulation line 12 and is introduced into the storage tank 2 at a relatively small flow rate (at least smaller than the circulation quantity in the first circulation line 11) while being cooled to a storage tank temperature (about 40° C.~80° C.) by the cooler 4. This is to prevent the persulfuric acid in the storage tank 2 from being diluted with the sulfuric acid solution introduced from the cleaning machine 1. Moreover, since the sulfuric acid solution is cooled by the cooler 4, the solution temperature in the storage tank 2 is prevented from rising which would expedite the self-decomposition of persufuric acid. In the present invention, the construction of the cooler 4 is not specially limited. There may be used a suitable cooling means such as, for example, a heat exchanger.

On the other hand, the large part of the sulfuric acid solution discharged from the cleaning machine 1 is transferred to the third circulation line 13 passing through the feed line of the second circulation line 12 on the upstream side and thereafter branching from it. This sulfuric acid solution is heated by the heater 5. At this time, by setting an outlet temperature of the heater 5 higher than an operation temperature of the cleaning machine 1, it is possible to compensate for the quantity of heat required. This high-temperature sulfuric acid solution and the sulfuric acid solution fed from the storage tank 2 are fed to the cleaning machine 1, whereby the solution temperature in the cleaning machine 1 reaches the operation temperature. Consequently, by joining the second circulation line 12 and the third circulation line 13 just before the liquid inlet side to the cleaning machine 1 as in this embodiment, the sulfuric acid solution containing highly concentrated persulfuric acid, which is fed through the second circulation line 12, is heated up in an instant and is introduced into the cleaning machine 1. Persulfuric acid decomposes by itself in a short time at a high temperature. Therefore, by heating-up the highly concentrated persulfuric acid-containing sulfuric acid solution in an instant, the heated sulfuric acid solution is introduced into the cleaning machine 1 with almost no room for self-decomposition of the persulfuric acid. Thus, the persulfuric acid stored in the storage tank 2 can be fed to the cleaning machine 1 without waste. In the present invention, the construction of the heater 5 is not specially limited. There may be used, for example, the heater or a heat exchanger. In the present invention, as described above, the storage tank is used for the purpose of holding persulfuric acid at a high concentration. Further, the temperature of the functional solution and the persulfuric acid concentration are adjusted so as to complete cleaning in the cleaning machine. Therefore, unlike the conventional art, the internal temperature of the storage tank is maintained at a predetermined low temperature.

In the case where the temperature of the cleaning machine 1 is high, for example, 130° C. or higher, it is presumed that persulfuric acid will decompose by itself in the interior of the cleaning machine 1, leading to loss. Actually, however, this is not waste. In order that the persulfuric acid may act as an oxidizing agent, it is necessary to maintain the interior of the cleaning machine 1 at a high temperature for formation of the sulfuric acid radical, since a sulfuric acid radical produced by the self-decomposition at a high temperature attacks an organic matter. Since the sulfuric acid radical in question is extremely short in life, it is required to be produced in the interior of the cleaning machine 1 which is the reaction site.

In the system of FIG. 1(*a*), however, the circulating solution in the first circulation line 11 is heated up as a result of heat generation by electrolysis and returns to the storage tank 2. Therefore, in consideration of this heated returning solution, it is necessary that the temperature of the sulfuric acid solution in the storage tank 2 be controlled by the cooler 4 disposed ahead of the storage tank 2. Thus, since the load on the cooler 4 has to be higher and the circulation quantity in the second circulation line 12 has to be larger, it is difficult to control. In this case, it is preferable that a cooler 6 be provided as second cooling means also behind the storage tank 2 as in the system of FIG. 1(*b*). Thus, the cooler 4 can control the temperature of the solution circulating in the second circulation line 12, while the cooler 6 can control the temperature of the solution circulating in the first circulation line 11, each independently, whereby it is possible to lower the load on the cooler 4 and make the amount of the solution circulating in the second circulation line 12 small. Without limitation to the system of FIG. 1(*b*), a cooler 7, for example, as second cooling means may perform cooling behind the electrolytic cell as in FIG. 1(*c*), if the temperature of the solution circulating in the first circulation line can be adjusted.

Although in the present invention the first circulation line is connected to the storage tank, the configuration is not limited to the direct return to the storage tank. That is, the first circulation line may be connected to the second circulation line on the upstream side of the storage tank and on the downstream side of the cooler, or the return line of the second circulation line may be branched (on the upstream side of the confluent point in case of joining the third circulation line) and used as a feed line of the first circulation line.

Although in the above embodiment the batch type substrate cleaning apparatus was shown as an apparatus to be supplied with the functional solution, no limitation is made thereto in the present invention. The functional solution may be supplied to use sides of various applications capable of using the electrolyzed sulfuric acid solution and may be used therein.

EXAMPLES

The following examples and comparative examples are given to make it clear that the system of the present invention is effective.

Example 1

Three Loops Type

Operation was performed using the system corresponding to FIG. 1(*a*). In the following examples, the first circulation line 11 is designated loop 1, the second circulation line 12 is designated loop 2, and the third circulation line 13 is designated loop 3.

(Operating Conditions)

Wafer: 300 mm dia., Resist thickness=860 nm
Cleaning machine 1: Temperature=140° C., Solution capacity=50 L,
Number of wafers processed=50 pieces/batch
Processing time required: 10 min/batch
Cleaning solution: Sulfuric acid concentration=85 wt %
Amount of persulfuric acid required in the cleaning machine 1=11.9 g/min.

(Material Balance)

Loop 1: Circulation quantity=8 L/min
Electrolytic cell 3 inlet temperature=50° C.
Electrolytic cell 3 outlet temperature=75° C.
Loop 2: Circulation quantity=6 L/min.
Cooler 4 outlet temperature=19° C.
Storage tank 2 temperature=50° C.
Storage tank 2 outlet: Persulfuric acid concentration=2.0 g/L
(Persulfuric acid circulation quantity=12.0 g/min)
Loop 3: Circulation quantity=19 L/min
Heater 5 outlet temperature=174° C.
Heater 5 heat load=29.2 kW That is, by providing the cooler 4, 12.0 g/min of persulfuric acid could be fed into the cleaning machine 1 at a circulation flow rate of 6 L/min. Moreover, since the temperature of the persulfuric acid solution just before introduction is 50° C., self-decomposition scarcely occurs and thus there is no waste.

Example 2

Three Loops Type

Operation was performed using the system corresponding to FIG. 1(*b*).

(Operating Conditions)

Wafer: 300 mm diameter, Resist thickness=860 nm
Cleaning machine 1: Temperature=140° C., Solution capacity=50 L,
Number of wafers processed=50 pieces/batch
Processing time required=10 min/batch
Cleaning solution: Sulfuric acid concentration=85 wt %
Amount of persulfuric acid required in the cleaning machine 1=11.9 g/min (Material Balance)

Loop 1: Circulation quantity=8 L/min
Electrolytic cell 3 inlet temperature=50° C.
Electrolytic cell 3 outlet temperature=75° C.
Loop 2: Circulation quantity=1 L/min
Cooler 4 outlet temperature=40° C.
Storage tank 2 temperature=72° C.

Persulfuric acid concentration at storage tank 2 outlet=11.9 g/L (Persulfuric acid circulation quantity=11.9 g/min)

Loop 3: Circulation quantity=24 L/min

Heater 5 outlet temperature=143° C.

Heater 5 heat load=3.8 kW

By providing the cooler 6, 11.9 g/min of persulfuric acid could be fed into the cleaning machine 1 at a circulation flow rate of 1 L/min. That is, by providing the cooler 6, it was possible to lower the load on the cooler 4 and decrease the circulation quantity in the loop 2. Moreover, since the circulation quantity in the loop 2 could be decreased, it was possible to lower the load on the heater 5. Thus, in this system, the temperature control became easy and it was possible to suppress the load on the heater and the load on the cooler.

Comparative Example 1

One Loop Type

Figure 2:
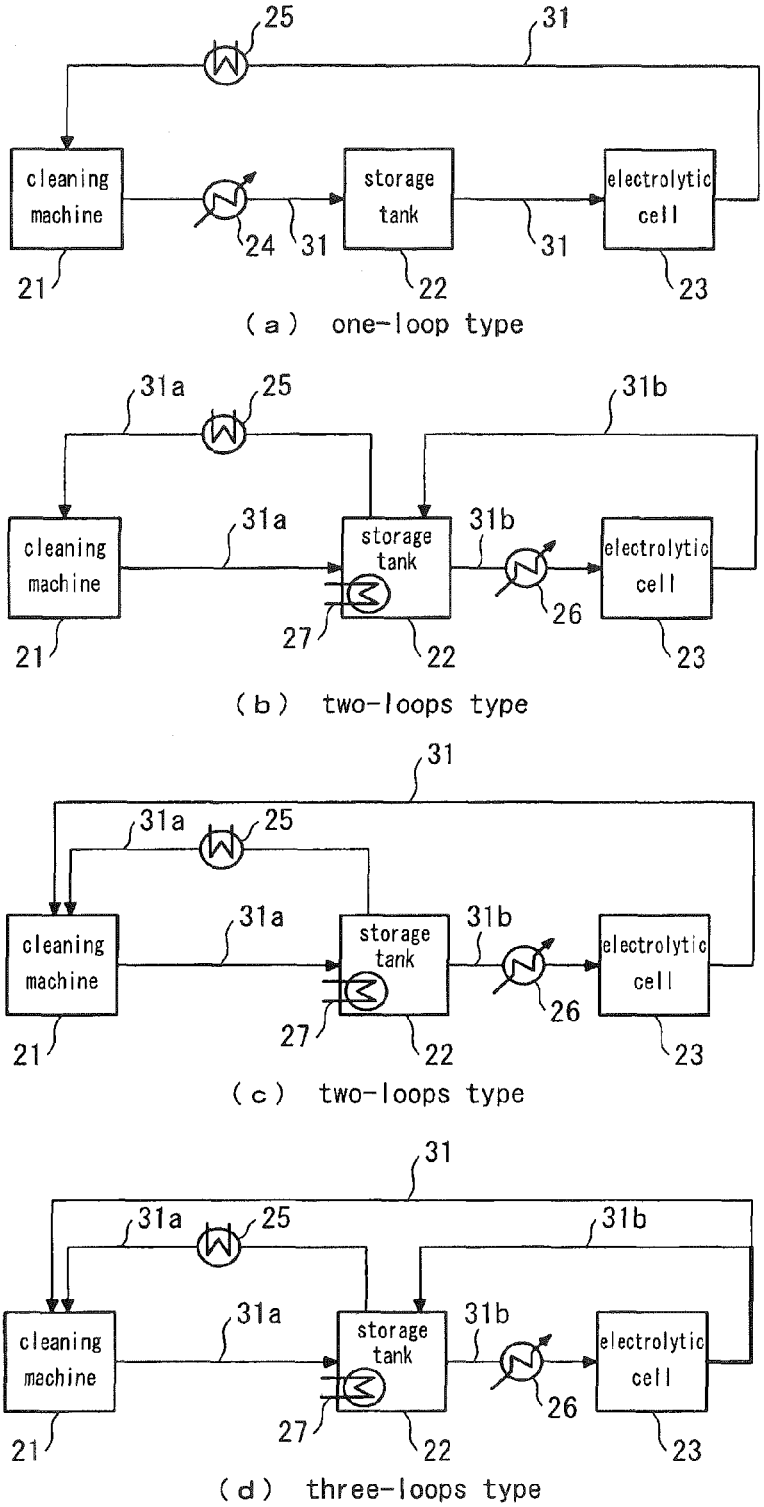
FIG. 2 is a diagram showing conventional one loop, two loops and three loops type functional solution supply systems.

Operation was performed using the system corresponding to FIG. 2(*a*).

(Operating Conditions)

Same as in Example 1. However, the loop number and the loop configuration do not always correspond to the examples. (This is also true in the following comparative examples.)

(Material Balance)

Loop 1: Circulation quantity=8 L/min

Electrolytic cell 23 inlet temperature=50° C.

Electrolytic cell 23 outlet temperature=75° C.

Persulfuric acid concentration at electrolytic cell 23 outlet=1.49 g/L (Persulfuric acid circulation quantity=11.9 g/min)

Heater 25 outlet temperature=140° C.

Heater 25 heat load=28.5 kW

That is, for feeding the required amount of persulfuric acid into the cleaning machine 21, the heat load on the heater 25 becomes extremely large, which is not practical. Besides, self-decomposition of persulfuric acid proceeded because of a long residence time thereof in the heater 25.

Comparative Example 2

Two Loops Type

Operation was performed using the system corresponding to FIG. 2(*b*).

(Operating Conditions)

Same as in Example 1.

(Material Balance)

Loop 1 (Circulation path 31*b*):

Circulation quantity=8 L/min

Electrolytic cell 23 inlet temperature=50° C.

Electrolytic cell 23 outlet temperature=76° C.

Persulfuric acid concentration at electrolytic cell 23 outlet=1.49 g/L (Persulfuric acid circulation quantity=11.9 g/min)

Cooler 26 outlet temperature=50° C.

Storage tank 22 temperature=125° C.

Loop 2 (Circulation path 31*a*):

Circulation quantity=25 L/min

Heater 25 outlet temperature=170° C.

Heater 25 heat load=20 kW

Persulfuric acid concentration at storage tank 22 outlet=0 g/L

That is, although the heat load on the heater 25 became smaller than that in Comparative Example 1, it is still excessive and not practical. Moreover, the persulfuric acid concentration at the outlet of the storage tank 22 became 0 g/L. A circulating solution having a persulfuric acid concentration of 1.49 g/L is supplied from the electrolytic cell 23 to the storage tank 22, but since the temperature of the storage tank 22 is adjusted to 125° C., it is presumed that the persulfuric acid in the storage tank 22 is substantially gone due to self-decomposition thereof.

Comparative Example 3

Two Loops Type

Operation was performed using the system corresponding to FIG. 2(*c*).

(Operating Conditions)

Same as in Example 1.

(Material Balance)

Loop 1 (Circulation paths 31, 31*b*):

Circulation quantity=8 L/min

Electrolytic cell 23 inlet temperature=50° C.

Electrolytic cell 23 outlet temperature=76° C.

Amount of liquid persulfuric acid at electrolytic cell 23 outlet=1.49 g/L (Persulfuric acid circulation quantity=11.9 g/min)

Cooler 26 outlet temperature=50° C.

Storage tank 22 temperature=140° C.

Loop 2 (Circulation path 31*a*):

Circulation quantity=17 L/min,

Heater 25 outlet temperature=170° C.

Heater 25 heat load=26 kW

Persulfuric acid concentration at cleaning machine 21 inlet=0.48 g/L

That is, the heat load on the heater 25 scarecely becomes small in comparison with Comparative Example 1 and is still excessive and not practical.

Comparative Example 4

Three Loops Type

Operation was performed using the system corresponding to FIG. 2(*d*).

(Operating Conditions)

Same as in Example 1. However, the circulation quantity indicates a circulation quantity at a portion where each loop does not join any other loop.

(Material Balance)

Loop 1 (Circulation path 31*b*):

Circulation quantity=3.2 L/min

Electrolytic cell 23 inlet temperature=50° C.

Electrolytic cell 23 outlet temperature=76° C.

Persulfuric acid concentration at electrolytic cell 23 outlet=1.49 g/L (Persulfuric acid circulation quantity=4.8 g/min)

Storage tank 22 temperature=133° C.

Loop 2 (Circulation path 31):

Circulation quantity=4.8 L/min

Persulfuric acid concentration at cleaning machine 21 inlet=1.49 g/L (Persulfuric acid circulation quantity=7.2 g/min)

Loop 3 (Circulation path 31*a*):

Circulation quantity=21.8 L/min

Heater 25 outlet temperature=155° C.

Heater 25 heat load=23.4 kW

Persulfuric acid concentration at storage tank 22 outlet=0 g/L

That is, although the heat load on the heater 25 becomes a little smaller than that in Comparative Example 1, it is still excessive and not practical. Besides, the persulfuric acid concentration at the outlet of the storage tank 22 became 0 g/L. A circulating solution having a persulfuric acid concentration of 1.49 g/L is supplied from the electrolytic cell 23 to the storage tank 22, but since the temperature of the storage tank 22 is adjusted to 133° C., it is presumed that the persulfuric acid in the storage tank 22 is substantially gone due to self-decomposition thereof.

The invention claimed is:

1. A functional solution supply system for electrolyzing a sulfuric acid solution to prepare a sulfuric acid solution containing persulfuric acid as a functional solution and for supplying the functional solution to a cleaning apparatus for using the functional solution, the system comprising an electrolyzing apparatus for electrolyzing the sulfuric acid solution, a storage tank for storing the sulfuric acid solution before electrolyzing the sulfuric acid solution and after electrolysis, heating means for heating the sulfuric acid solution, cooling means for cooling the sulfuric acid solution, and including the following three circulation lines:

1. a first circulation line for returning the sulfuric acid solution discharged from the storage tank through the electrolyzing apparatus without passing through the heating means to the storage tank;
2. a second circulation line for returning the sulfuric acid solution, introduced from the cleaning apparatus, through the cooling means and the storage tank in this order without passing through the heating means, to the cleaning apparatus; and
3. a third circulation line for returning the sulfuric acid solution, introduced from the cleaning apparatus, through the heating means without passing through the cooling means and the storage tank, to the cleaning apparatus.

2. The functional solution supply system according to claim 1, wherein the second circulation line and the third circulation line join just before the return to the cleaning apparatus.

3. The functional solution supply system according to claim 2, wherein the second circulation line and the third circulation line are branched after being introduced from the cleaning apparatus.

4. The functional solution supply system according to claim 2, wherein on a downstream side of the storage tank and on an upstream side of the electrolyzing apparatus the first circulation line includes second cooling means for cooling the sulfuric acid solution.

5. The functional solution supply system according to claim 2, wherein on a downstream side of the electrolyzing apparatus and on an upstream side of the storage tank the first circulation line includes third cooling means for cooling the sulfuric acid solution.

6. The functional solution supply system according to claim 2, wherein the cleaning apparatus is a batch cleaning apparatus to clean a substrate.

7. The functional solution supply system according to claim 1, wherein the second circulation line and the third circulation line are branched after being introduced from the use side cleaning apparatus.

8. The functional solution supply system according to claim 7, wherein on a downstream side of the storage tank and on an upstream side of the electrolyzing apparatus the first circulation line includes second cooling means for cooling the sulfuric acid solution.

9. The functional solution supply system according to claim 7, wherein on a downstream side of the electrolyzing apparatus and on an upstream side of the storage tank the first circulation line includes third cooling means for cooling the sulfuric acid solution.

10. The functional solution supply system according to claim 7, wherein the cleaning apparatus is a batch cleaning apparatus to clean a substrate.

11. The functional solution supply system according to claim 1, wherein on a downstream side of the storage tank and on an upstream side of the electrolyzing apparatus the first circulation line includes second cooling means for cooling the sulfuric acid solution.

12. The functional solution supply system according to claim 11, wherein the cleaning apparatus is a batch cleaning apparatus to clean a substrate.

13. The functional solution supply system according to claim 1, wherein on a downstream side of the electrolyzing apparatus and on an upstream side of the storage tank the first circulation line includes third cooling means for cooling the sulfuric acid solution.

14. The functional solution supply system according to claim 13, wherein the cleaning apparatus is a batch cleaning apparatus to clean a substrate.

15. The functional solution supply system according to claim 1, wherein the cleaning apparatus is a batch cleaning apparatus to clean a substrate.

16. A functional solution supply method for electrolyzing a sulfuric acid solution to prepare a sulfuric acid solution containing persulfuric acid as a functional solution and supplying the functional solution to a cleaning apparatus for using the functional solution, comprising:

a circulation step of discharging a sulfuric acid solution from a storage tank for storing the sulfuric acid solution before electrolyzing and the sulfuric acid solution after electrolyzing, electrolyzing the sulfuric acid solution without being passed through heating by heating means, and returning the sulfuric acid solution after the electrolysis to the storage tank;

a circulation step of cooling the sulfuric acid solution introduced from the cleaning apparatus, by cooling means, without being passed through the heating by the heating means, feeding the sulfuric acid solution after the cooling to the storage tank, discharging the sulfuric acid solution from the storage tank and returning it to the cleaning apparatus; and a circulation step of heating the sulfuric acid solution introduced from the use cleaning apparatus, by the heating means, without being passed through the cooling by the cooling means and without being passed through the storage tank, and returning the heated sulfuric acid solution to the cleaning apparatus.

17. The functional solution supply method according to claim 16, wherein in the circulation step of returning the sulfuric acid solution introduced from the cleaning apparatus to the cleaning apparatus from the storage tank and the circulation step of returning the sulfuric acid solution introduced from the cleaning apparatus to the cleaning apparatus without being passed through the storage tank, the sulfuric acid solution not having been passed through the heating and the sulfuric acid solution having been passed through the heating are joined just before the return to the cleaning apparatus and are returned in the joined state to the cleaning apparatus.

* * * * *